US009457394B2

(12) United States Patent
Comer

(10) Patent No.: US 9,457,394 B2
(45) Date of Patent: Oct. 4, 2016

(54) METHOD AND SYSTEM FOR UPSETTING HOLLOW MEMBERS

(75) Inventor: William K. Comer, Paris (CA)

(73) Assignee: Magna International Inc., Aurora, Ontario (CA)

( * ) Notice: Subject to any disclaimer, the term of this patent is extended or adjusted under 35 U.S.C. 154(b) by 987 days.

(21) Appl. No.: 12/673,032

(22) PCT Filed: Aug. 7, 2008

(86) PCT No.: PCT/CA2008/001435

§ 371 (c)(1),
(2), (4) Date: Feb. 11, 2010

(87) PCT Pub. No.: WO2009/021320

PCT Pub. Date: Feb. 19, 2009

(65) Prior Publication Data

US 2011/0314889 A1 Dec. 29, 2011

Related U.S. Application Data

(60) Provisional application No. 60/956,198, filed on Aug. 16, 2007.

(51) Int. Cl.

| | |
|---|---|
| ***B21K 21/12*** | (2006.01) |
| *B21J 5/08* | (2006.01) |
| *B21J 9/06* | (2006.01) |

(52) U.S. Cl.

CPC ..... *B21K 21/12* (2013.01)

(58) Field of Classification Search

CPC ..... B21K 1/30; B21K 21/12; B21C 23/14; B21C 1/24; B21C 37/202; B21C 37/065; B21D 9/125; B21D 22/02; B21D 28/20; B21D 24/02; B21D 28/32; B30B 1/40; B25B 27/146; B21J 9/18; B21J 5/08; B21J 9/06; B21J 13/03; B21J 13/085; B21B 19/04; B21B 23/00; B21B 45/00; A61M 5/329

USPC ..... 72/343, 452.1, 452.8, 452.9, 367.1, 72/370.01, 370.03, 370.14, 370.15, 72/370.24, 293–323

See application file for complete search history.

(56) References Cited

U.S. PATENT DOCUMENTS

| | | | | |
|---|---|---|---|---|
| 599,266 | A | 2/1898 | Smith | |
| 1,837,097 | A | 12/1931 | Barth | |
| 1,983,584 | A * | 12/1934 | Urschel | B21C 37/15 72/302 |
| 2,078,195 | A | 4/1937 | Cornell, Jr. | |
| 2,319,546 | A | 5/1943 | Insley et al. | |
| 3,136,053 | A * | 6/1964 | Powell | 72/57 |
| 3,224,243 | A | 12/1965 | Van Deberg | |
| 4,048,703 | A | 9/1977 | Lehnhart | |

(Continued)

FOREIGN PATENT DOCUMENTS

| | | | |
|---|---|---|---|
| EP | 623404 | A2 * | 11/1994 |
| JP | 59215225 | | 12/1984 |

*Primary Examiner* — David Bryant
*Assistant Examiner* — Lawrence Averick
(74) *Attorney, Agent, or Firm* — Dickinson Wright PLLC

(57) ABSTRACT

An apparatus and method for upsetting an end of a hollow workpiece to increase the wall thickness of that end is taught. A mandrel is inserted into the workpiece within a clamp which holds the workpiece. A die is urged into contact with the end of the workpiece to compress the end, decreasing its length and increasing the wall thickness of the end while the mandrel and clamp prevent deformation of the workpiece held in the clamp.

17 Claims, 5 Drawing Sheets

(56) References Cited

U.S. PATENT DOCUMENTS

| | | | | |
|---|---|---|---|---|
| 4,213,322 | A * | 7/1980 | Barnes, Jr. | 72/357 |
| 5,184,495 | A * | 2/1993 | Chunn et al. | 72/318 |
| 5,203,194 | A | 4/1993 | Marquardt | |
| 5,283,951 | A | 2/1994 | Davenport et al. | |
| 5,517,843 | A * | 5/1996 | Winship | 72/306 |
| 5,884,521 | A * | 3/1999 | Fidziukiewicz | 72/452.9 |
| 6,145,185 | A | 11/2000 | Hwang | |
| 6,408,672 | B1 | 6/2002 | Roe et al. | |
| 6,931,906 | B2 * | 8/2005 | Sorgi | 72/370.03 |
| 7,647,802 | B2 * | 1/2010 | Knirk et al. | 72/115 |
| 2003/0221474 | A1 * | 12/2003 | Sorgi | 72/370.11 |
| 2005/0005667 | A1 * | 1/2005 | Greczanik et al. | 72/370.03 |

* cited by examiner

METHOD AND SYSTEM FOR UPSETTING HOLLOW MEMBERS

CROSS-REFERENCE TO RELATED APPLICATIONS

This U.S. National Stage Patent Application claims the benefit of PCT International Patent Application Serial No. PCT/CA2008/001435 filed Aug. 7, 2008 entitled "Method And System For Upsetting hollow Members," which claims the benefit of U.S. Provisional Patent Application Ser. No. 60/956,198 filed Aug. 16, 2007, the entire disclosures of the applications being considered part of the disclosure of this application and hereby incorporated by reference.

FIELD OF THE INVENTION

The present invention relates to a system and method for upsetting hollow metal members. More specifically, the present invention relates to a system and method for upsetting hollow metal members without requiring the member to be heated for the upsetting operation.

BACKGROUND OF THE INVENTION

It is sometimes required to have a hollow metal member with a thicker gauge (wall thickness) at a relatively small portion of one end or both ends, of the member while the majority of the length of the member between the ends can be a second, thinner, gauge. For example, rear axles in front wheel drive passenger vehicles are typically manufactured from a hollow tubular metal member which is formed into the required configuration in a press. While the axle requires a given wall thickness, for example three millimeters, along most of its length, the end portions of the axle can require an increased wall thickness, for example four and a half millimeters, to allow them to be affixed, by welding, to the wheel hub structures.

Rather than employ a feedstock member having the greater wall thickness (e.g. four and a half millimeters) along its entire length, (which would increase material costs and the weight of the member) it is known to employ a feedstock member having the smaller wall thickness (e.g. three millimeters) and to upset, or bulge, the ends of the feedstock member to obtain the necessary larger wall thickness required at the ends of the axle.

Conventionally, upsetting involves heating the end portions of the hollow member to place the material in a malleable state and then longitudinally compressing the member to deform it, increasing the wall thickness (gauge) of the hollow member in the treated area while decreasing its length.

While hot upsetting provides an advantage in that localized areas of increased gauge can be created, it does suffer from some disadvantages. In particular, hot upsetting must be performed at a separate manufacturing station where the ends of the hollow member can be heated and compressed and this increases the manufacturing time for the finished part, as well as the increasing the capital costs associated with providing a separate upsetting station and increasing the operating costs associated with operating the heaters for the upsetting operation.

Further, the heating required for hot upsetting requires a heating and cooling cycle for the upset portions of the hollow member and this heating and cooling cycle alters the properties of the hollow member in the upset areas. This typically necessitates that the upset areas be subsequently treated to harden the upset areas, adding a further process expense.

It is desired to have a method and system for upsetting at least one end portion of a hollow member which does not require the heating of the hollow member.

SUMMARY OF THE INVENTION

It is an object of the present invention to provide a novel system and method for upsetting a portion of a hollow member which obviates or mitigates at least one disadvantage of the prior art.

According to a first aspect of the present invention, there is provided a method of upsetting a hollow workpiece, comprising the steps of: loading a workpiece into a clamp, the clamp having an inner shape complementary to the outer surface of the workpiece, and an end of the workpiece which is to be upset extending outside of the clamp; inserting a mandrel into the interior of the workpiece, through a die located adjacent the end of the workpiece, the mandrel having a complementary shape to the interior cross section of the workpiece and the mandrel extending sufficiently into the workpiece to enter the portion of the workpiece to be held in the clamp; closing the clamp about the workpiece; urging the die toward the clamp to bring the die into contact with the workpiece; driving the die toward the clamp to decrease the length of the end of the workpiece to be upset while increasing the wall thickness of that portion; and once the die has been urged a pre-selected distance towards the clamp, retracting the die from the end, retracting the mandrel from the workpiece, and opening the clamp to remove the upset workpiece.

According to another aspect of the present invention, there is provided an apparatus for upsetting a hollow workpiece comprising: a clamp having a clamp surface shape and size complementary to the outer shape of a hollow workpiece; means for exerting a force onto the clamp to close the clamp on the workpiece with an end of the workpiece to be upset extending outside the clamp; a mandrel having a size and shape complementary to the interior surface of the workpiece; a die having an inner shape and size corresponding to the desired upset size and shape of the end of the workpiece; and a drive operable to move the die toward the clamp such that the die engages the end of the workpiece to be upset, the drive further operable to urge the die through a pre-selected distance towards the clamp to decrease the length of the end of the workpiece while upsetting it.

The present invention provides an apparatus and method for upsetting a portion of a hollow workpiece to increase the wall thickness of the workpiece. A mandrel is inserted into an exposed end of the workpiece and into a clamp, which is then closed to hold the workpiece. A die is forced against the exposed end of the workpiece to upset the exposed end by compressing the end towards the clamp, decreasing its length and increasing the wall thickness of the hollow member as required.

BRIEF DESCRIPTION OF THE DRAWINGS

Preferred embodiments of the present invention will now be described, by way of example only, with reference to the attached Figures, wherein.

DETAILED DESCRIPTION OF THE INVENTION

Figure 1:
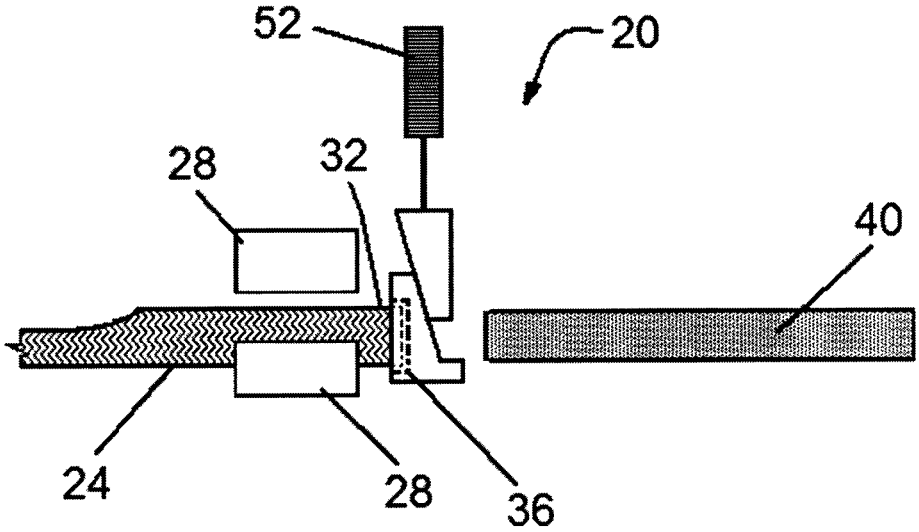
FIG. 1 shows a schematic representation of an upsetting apparatus in accordance with the present invention.

Apparatus for performing upsetting, in accordance with the present invention, is indicated generally at 20 in FIG. 1. In FIG. 1, a hollow workpiece 24 is loaded in an upsetting clamp 28 with the end 32 of hollow workpiece 24 which is to be upset being inserted into an upsetting die 36. The interior dimensions of die 36 correspond to the desired finished upset size for workpiece 24.

Figure 2:
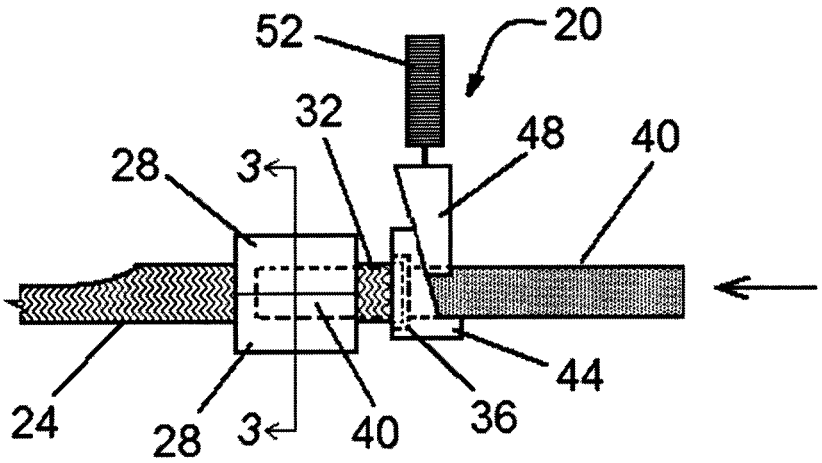
FIG. 2 shows the apparatus of FIG. 1 with a clamp closed about a workpiece and with a portion of a mandrel extended into the workpiece and clamp.

Once workpiece 24 is loaded in clamp 28 and die 36, a mandrel 40 is inserted into the interior of workpiece 24, through dies 36 via a through-passage, and extends into workpiece 24 such that at least a portion of mandrel 40 is within clamp 28, as shown in FIG. 2. The outer dimensions of mandrel 40 closely correspond to the inner dimensions of workpiece 24.

Figure 3:
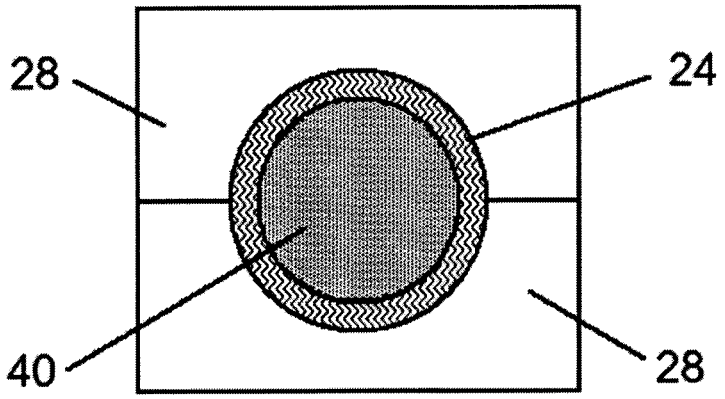
FIG. 3 shows a cross section, taken through line 3-3 of FIG. 2, of a clamp, workpiece and mandrel in accordance with the present invention.

Clamp 28 is then closed, as shown in FIG. 2, and tightly engages the outer surface of workpiece 24. Clamp 28 and mandrel 40 prevent any deformation of the portion of workpiece 24 held within clamp 28 as shown in FIG. 3.

In the illustrated embodiment, workpiece 24 has a circular outer shape and clamp 28 has a corresponding circular shape of its inner clamp surface to receive workpiece 24 and mandrel 40 also has an outer circular shape and size corresponding to the circular shape of the interior of workpiece 24. However, as will be apparent to those of skill in the art, the present invention is not limited to upsetting hollow workpieces 24 with circular outer (or inner) shapes.

The end 32 of workpiece 24 to be upset extends beyond clamp 28, as shown in FIGS. 1 and 2, into die 36.

Figure 4:
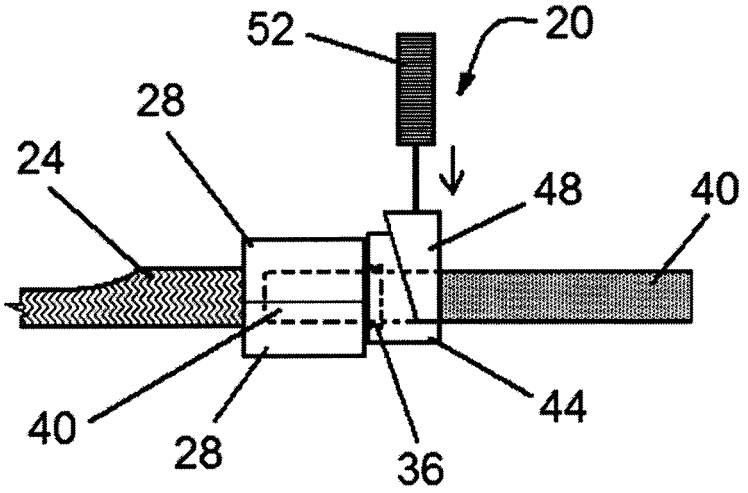
FIG. 4 shows the apparatus of FIG. 2 with a die urged towards the clamp.

Once clamp 28 is closed and mandrel 40 is inserted into workpiece 24, upsetting die 36 is forced towards clamp 28, as shown in FIG. 4, upsetting end 32 by shortening its length while increasing its gauge. Specifically, the length of end 32 is decreased and the material which is displaced by this decrease in length is added to the wall thickness of end 32, increasing its gauge. Mandrel 40 prevents the inner dimensions of end 32 from changing, and the displaced material therefore increases the wall thickness of end 32 until the outer dimensions of end 32 correspond to the inner dimensions of die 36.

As will be apparent to those of skill in the art, the force required to move die 36 towards clamp 28 can be significant. In a presently preferred embodiment of the invention, die 36 is mounted to one half cam 44 of a cam-based force multiplier. The other half cam 48 of the cam-based force multiplier is connected to a hydraulic ram 52 which, when extended, moves half cam 48 laterally with respect to the length of end 32. As will be understood by those of skill in the art, half cam 48 includes a cam surface which rides on a complementary cam surface on half cam 44, converting the lateral force exerted on half cam 48 by ram 52 into longitudinal force on half cam 44, and die 32, and increasing the longitudinal force applied to die 36, and end 32, from that generated by ram 52.

However, as will be apparent to those of skill in the art, the present invention is not limited to the use of force multipliers to move die 36 into contact with end 32 and force can be applied directly to die 36 (or a suitable carrier) in any appropriate manner as will occur to those of skill in the art.

Figure 5:
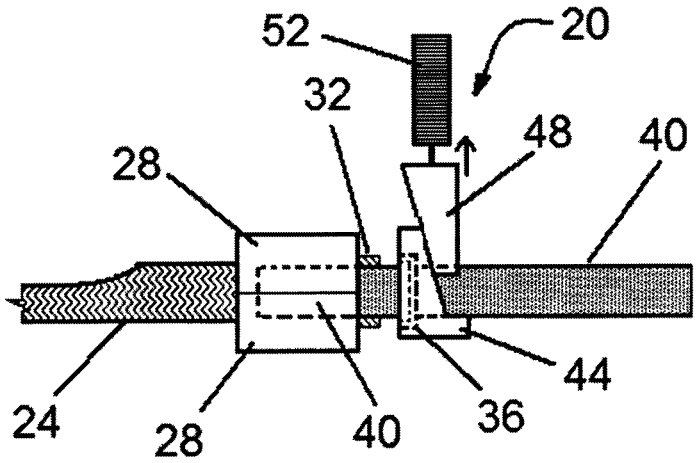
FIG. 5 shows the apparatus of FIG. 4 with the die retracted from the upset workpiece.

When die 36 has been driven a predetermined distance towards clamp 28, achieving the desired upsetting, ram 52 is stopped and reversed. A ram (not shown) or other suitable means moves die 36 away from clamp 28, exposing upset end 32 as shown in FIG. 5.

Figure 6:
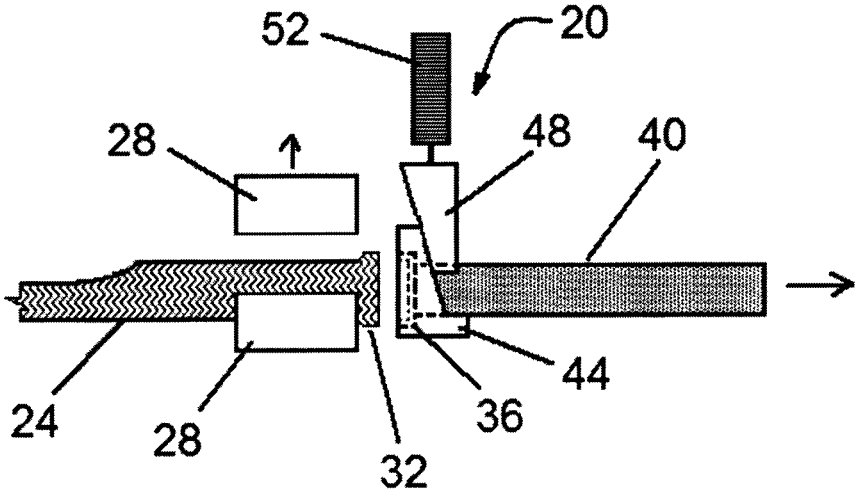
FIG. 6 shows the apparatus of FIG. 5 with the mandrel retracted and the clamp opened to allow removal of the upset workpiece.

The clamp pressure on clamp 28 is reduced to allow mandrel 40 to be retracted and then clamp 28 is released, as shown in FIG. 6, and upset workpiece 24 can be removed from apparatus 20.

A method in accordance with the present invention can be considered to comprise the steps of: loading a workpiece into a clamp, the clamp having a shape complementary to the outer surface of the workpiece, and the portion of the workpiece which is to be upset extending outside of the clamp; inserting a mandrel into the interior of the workpiece through a die located adjacent end of the workpiece to be upset, the outer surface of the mandrel having a complementary shape complementary to the interior cross section of the workpiece and the mandrel extending sufficiently into the workpiece to enter the portion of the workpiece to be held in the clamp; closing the clamp; urging the die toward the clamp to bring the die into contact with the workpiece; driving the die toward the clamp to decrease the length of the end of the workpiece to be upset while increasing the wall thickness of that end; and once the die has been force a pre-selected distance towards the clamp, retracting the die and the mandrel from the workpiece and opening the clamp to remove the upset workpiece.

It should be appreciated that the orientation of die 36 and mandrel 40 relative to end 32 of workpiece 24 allows a concurrent upsetting operation to be performed at the opposite end of workpiece 24. In particular, it is contemplated that another die and another mandrel substantially the mirror images of die 36 and mandrel 40 are positioned at the opposite end of workpiece 24. The another die and another mandrel are moveable in the same manner as die 36 and mandrel 40 to upset the opposite end of workpiece 24. Die 36 and the other die may be simultaneously driven into contact with workpiece 24 to substantially simultaneously upset both ends of workpiece 24. A singular clamp 28 may be used or another clamp may be added to grasp workpiece 24 near the end opposite end 32, depending on the length of workpiece 24.

Figure 7A:
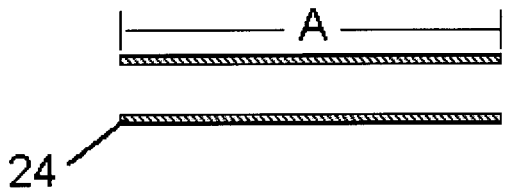
FIG. 7*a* shows a workpiece prior to upsetting.
Figure 7B:
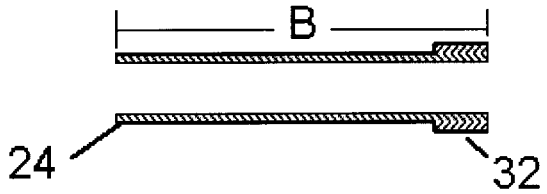
FIG. 7*b* shows the workpiece of FIG. 7*a* after upsetting.

FIG. 7*a* shows a workpiece 24 prior to upsetting in apparatus 20. As shown, workpiece 24 has a length of A and includes an end 32 which is to be upset. FIG. 6*b* shows the workpiece 24 of FIG. 6*a* after upsetting in apparatus 20. As shown, the length of workpiece 24 has been reduced by the upsetting from a length of A to a length of B and the wall gauge of workpiece 24 in end 32 has been increased.

In a specific example of the present invention, a workpiece comprising a circular tube of 22MNB5 steel which has been subjected to an NBK process (comprising post rolling annealing at approximately 920° C. in a controlled atmosphere and controlled heating and cooling cycles) has an end upset. The wall thickness of the workpiece is 3.2 mm with the outer diameter of the workpiece being 90 mm. After upsetting, the upset portion has a wall thickness of approximately 4.2 mm, and an outer diameter of about 92 mm, and the length of the workpiece is reduced by approximately 15 mm.

In this example, apparatus 20 forms part of a press station for forming workpiece 24 and clamp 28 is closed by the same hydraulic press which is otherwise used to form workpiece 24. Accordingly, clamp 28 is closed with a force in excess of 250 tonnes. Ram 52, produces in excess of 50 tonnes of force, which the cam-based force multiplier converts to greater than 150 tonnes of lateral force on die 36 and end 32.

As will be apparent to those of skill in the art, apparatus 20 can be provided as a separate workstation in a manufacturing process, but as mentioned above, it is contemplated that one of the advantages of the present invention is that apparatus 20 can be included in an existing workstation, such as a forming press. In this manner, cycle times can be reduced, along with the capital expenses which would otherwise be required to establish a separate work station and/or the need for additional plant floor space.

Further, as the method of the present invention does not require heating of workpiece 24 for upsetting, the capital and operating expenses which would be associated with upsetting heaters is avoided and the need for additional hardening or other processing treatments can be avoided.

Figure 8A:
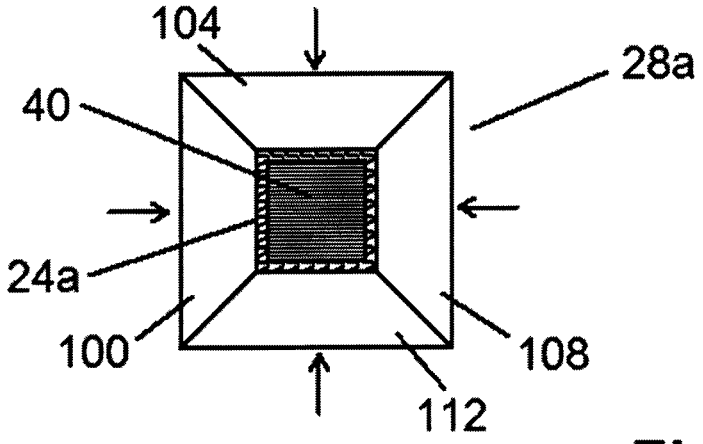
FIG. 8*a* shows a cross section through a clamp, workpiece and mandrel where the workpiece is square in cross section.

As mentioned above, while the illustrated embodiment shows workpiece 24 as having a circular cross section, the present invention is not so limited. FIG. 8*a* shows a cross section through a clamp 28*a* for a workpiece 24*a* with a square cross section. Clamp 28*a* includes four moveable clamp portions 100, 104, 108 and 112 each of which is urged into contact with a respective side of workpiece 24*a* when clamp 28*a* is closed.

As will be apparent to those of skill in the art, in this embodiment, mandrel 40 has a square cross section corresponding to the interior cross section of workpiece 24*a*.

Figure 8B:
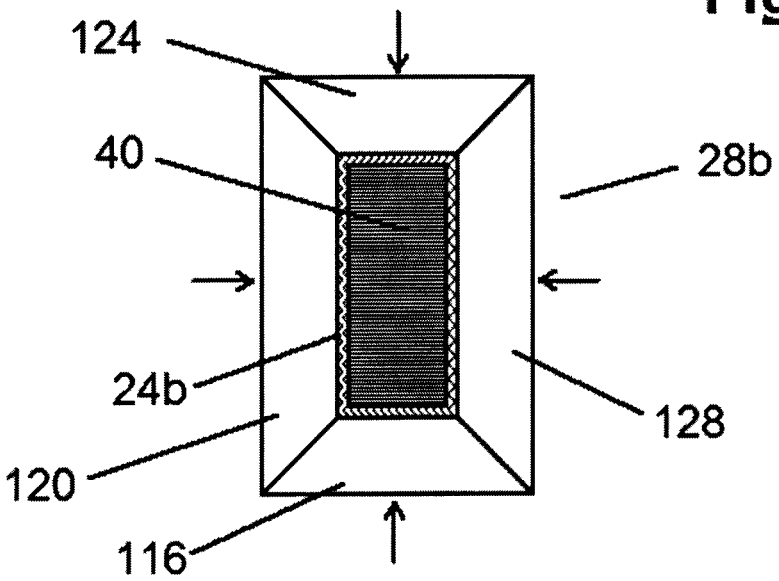
FIG. 8*b* shows a cross section through a clamp, workpiece and mandrel where the workpiece is rectangular in cross section.

Similarly, FIG. 8*b* shows a clamp 28*b* for a workpiece 24*b* with a rectangular cross section. Clamp 28*b* includes four moveable clamp portions 116, 120, 124 and 128 each of which is urged into contact with a respective side of workpiece 24*b* when clamp 28*b* is closed. As with the embodiment of FIG. 8*a*, in this embodiment, mandrel 40 has a square cross section which is complementary to the interior cross section of workpiece 24*b*. In both of these examples, die 36 will have a shape and size which corresponds to the desired upset end 32, whether that desired upset end 32 is square, rectangular or any other desired shape.

It is further contemplated that die 36 can include one or more desired features, such as a flat or spline, which is formed into the corresponding part of the outer surface of upset portion 30 by dies 36 when the upsetting is performed.

The above-described embodiments of the invention are intended to be examples of the present invention and alterations and modifications may be effected thereto, by those of skill in the art, without departing from the scope of the invention which is defined solely by the claims appended hereto.

What is claimed is:

1. An apparatus for upsetting a hollow workpiece, comprising:

a clamp for gripping the workpiece at a location offset from an open end of the workpiece that is to be upset, the clamp having a clamp surface shaped and sized complementary to the outer shape of a hollow workpiece;

a one-piece die and first half cam having an inner cavity shaped and sized corresponding to a desired upset size and shape of the end of the workpiece and having a through-passage and having a first cam surface;

a mandrel having a size and shape complementary to the interior surface of the workpiece, the mandrel being moveable into and out of the open end of the workpiece that is to be upset, the mandrel being positionable within the clamped portion of the workpiece, wherein the mandrel is axially moveable from a first position clear of the die and the clamp to a second position within the die and the clamp, the mandrel first entering the through-passage of the die from a side of the die opposite of the clamp and next entering the hollow interior of the workpiece and then entering the clamp; and a drive operable to move the die toward the clamp such that the die engages the end of the workpiece to be upset, the drive further operable to urge the die a pre-selected distance toward the clamp to upset the workpiece including decreasing the length of the end of the workpiece while increasing the wall thickness of the workpiece, the drive including a second half cam with a second cam surface that is shaped complementary to said first cam surface of said first half cam, and the drive including a ram operable to urge the second cam surface against the first cam surface to urge the die towards the clamp.

2. The apparatus of claim 1 wherein the die includes a throughbore in communication with the cavity, the mandrel being positioned within the throughbore during upsetting.

3. The apparatus of claim 2 wherein the cavity of the die is defined by a cylindrical wall intersecting a substantially planar drive face, the drive face being engageable with an end face of the workpiece.

4. The apparatus of claim 1 wherein the cavity has an outer dimension larger than the size of the outer surface of the workpiece prior to upsetting to increase the wall thickness of the workpiece greater than 30%.

5. The apparatus of claim 1 further including another mandrel, another die and another drive in cooperation with each other to upset an opposite open end of the workpiece.

6. The apparatus of claim 5 wherein the drive and the another drive are operable to move the die and the another die toward one another to upset opposite ends of the workpiece.

7. The apparatus of claim 1 wherein the cavity has a wall with one of a circular and a rectangular shape.

8. The apparatus of claim 1 wherein the clamp includes four independently moveable sections each operable to engage an outer surface of a workpiece having a rectangular outer shape.

9. The apparatus of claim 1 wherein the mandrel has a rectangular outer shape.

10. A method of upsetting a hollow and unheated workpiece, comprising the steps of:

loading an unheated workpiece into a clamp, the clamp having a shape complementary to the outer surface of the workpiece;

extending an open end of the unheated workpiece that is to be upset outside of the clamp;

inserting a mandrel into the interior of the unheated workpiece, through a die having a through-passage located adjacent the end of the workpiece and into the open end of the unheated workpiece, the mandrel having a complementary shape to the interior cross section of the unheated workpiece and the mandrel first entering the through-passage of the die from a side opposite of the clamp and next entering the unheated workpiece and then entering the clamp;

closing the clamp;

urging the die toward the clamp to bring the die into contact with the unheated workpiece;

driving the die toward the clamp to decrease the length of the end of the unheated workpiece to be upset while increasing the wall thickness of that portion; and once the die has been urged a pre-selected distance toward the clamp, retracting the die from the end, retracting the mandrel from the workpiece, and opening the clamp to remove the upset and unheated workpiece.

11. The method of claim 10, wherein the die includes a cavity defined by a cylindrical wall intersecting a substantially planar drive face, the method further including engaging the drive face with an end face of the workpiece.

12. The method of claim 11 further including extending the mandrel through a bore formed in the die that is in communication with the cavity.

13. The method of claim 10 further including engaging a cam with a cam face formed on the die to move the die toward the clamp.

14. The method of claim 13 further including axially translating the cam in a first direction to axially translate the die in a second direction substantially perpendicular to the first direction.

15. The method of claim 10 further including increasing the wall thickness of the workpiece greater than 30%.

16. The method of claim 10 further including moving independent clamp sections relative to each other to engage a rectangular outer surface of the workpiece.

17. The method of claim 10 further including driving another die toward the clamp to decrease the length of an opposite end of the workpiece while increasing the wall thickness of the opposite end.

* * * * *